US007937799B2

(12) United States Patent
Riggs

(10) Patent No.: US 7,937,799 B2
(45) Date of Patent: May 10, 2011

(54) CONTAINER CLEANING MACHINE

(76) Inventor: Mark Aaron Riggs, Battle Creek, MI (US)

( * ) Notice: Subject to any disclaimer, the term of this patent is extended or adjusted under 35 U.S.C. 154(b) by 899 days.

(21) Appl. No.: 11/901,585

(22) Filed: Sep. 18, 2007

(65) Prior Publication Data

US 2008/0066256 A1 Mar. 20, 2008

Related U.S. Application Data

(60) Provisional application No. 60/835,630, filed on Sep. 19, 2006.

(51) Int. Cl.
*A47L 5/14* (2006.01)

(52) U.S. Cl. ..... 15/304; 15/339; 15/345

(58) Field of Classification Search ..... 15/301, 15/304, 339, 345; *A47L 5/14*
See application file for complete search history.

(56) References Cited

U.S. PATENT DOCUMENTS

| | | | | |
|---|---|---|---|---|
| D307,365 | S | 4/1990 | Dry et al. | |
| 5,238,503 | A * | 8/1993 | Phenix et al. | 134/37 |
| 5,279,017 | A | 1/1994 | Foreahew | |
| 5,414,893 | A | 5/1995 | Hampton et al. | |
| 5,546,631 | A | 8/1996 | Chambon | |
| 5,706,548 | A * | 1/1998 | Schabacker | 15/322 |
| 5,881,429 | A | 3/1999 | Drewitz | |
| 6,249,932 | B1 * | 6/2001 | Chu et al. | 15/345 |
| 6,783,603 | B2 | 8/2004 | Russell | |
| 7,441,304 | B2 * | 10/2008 | Maier et al. | 15/345 |
| 2005/0166360 | A1 | 8/2005 | Fox | |

* cited by examiner

*Primary Examiner* — David A Redding
(74) *Attorney, Agent, or Firm* — Joseph K. Andonian

(57) ABSTRACT

A container cleaning apparatus comprising a table having holes in the top surface suitably arranged to deliver compressed air and a vacuum substantially simultaneously into the open top of an inverted reusable container placed on the table top and thereby remove debris from the inside of the container.

6 Claims, 3 Drawing Sheets

CONTAINER CLEANING MACHINE

This application was preceded by provisional application No. 60/835,630 filed on Sep. 19, 2006.

FIELD OF THE INVENTION

The present invention relates to a machine for cleaning containers, especially reusable containers. Manufacturers and warehousemen often use containers repeatedly to save money. Some type of machine or method for cleaning such containers is therefore necessary.

BACKGROUND OF THE INVENTION

Industrial facilities often use containers or totes for transporting products or loose materials from one location to another. Repeated use of these containers makes their use more economical. Therefore there is a need for removing debris such as small particles or shavings of metal, plastic, paper and foam that commonly accumulate in these containers after each use.

U.S. Pat. No. 5,279,017 describes a method and apparatus for extracting particles from such containers. The apparatus described includes two caps that close in succession over the open top of containers passing beneath the caps on a conveyer. The first cap supplies high pressure into the containers to loosen particles from the container and the second cap follows with low pressure to remove the particles.

U.S. Pat. No. 5,546,631 describes a system for cleaning containers such as soda cans and bottles. The apparatus described employs a chamber in which the containers are placed. Compressed air is directed through a nozzle into the containers to dislodge foreign particles and fluids. A vacuum blower operates in conjunction with the pressure blower to remove the contaminated air from the chamber.

U.S. Pat. No. 5,881,429 describes an apparatus for cleaning empty inverted containers that pass over a first station that blasts ionized gas up into the container and a second station that sucks out the suspended contaminants from the container.

U.S. Pat. No. Des. 307,365 describes a fish cleaning table with ports that could conceivably be employed to dispose of debris.

U.S. Patent Application No. 2005/0166360A1 describes a system for cleaning a surface that employs airflow across the surface and exhaust air to remove debris from a debris collection chute.

U.S. Pat. No. 6,783,603B2 discloses a method for cleaning contact lens molds including the steps of placing the mold within an enclosed or substantially enclosed area, directing a gas under pressure against the mold and providing an outflow of gas to remove the dislodged debris.

U.S. Pat. No. 5,414,893 discloses a method for improving the manufacture of a vacuum cleaner that employs a foot switch actuator.

In combination the prior art reveals a need for container cleaners and the feasibility of employing air under pressure and a vacuum to facilitate cleaning. The prior art does not disclose the use of, or advantages flowing from use of, a flat surface out of which compressed air and a vacuum in a special configuration are simultaneously directed into the open top of an inverted, container placed on the flat surface. Moreover the prior art does not disclose how to clean containers effectively at the same low cost provided for in the present invention.

SUMMARY OF THE INVENTION

The present invention comprises a flat surface, such as a table top, with a centrally located port or opening connected to a vacuum or low pressure source surrounded by ports or openings connected to a source of compressed or high pressure air. When an inverted open topped container is placed over the ports and appropriate amounts of high and low pressure air are substantially simultaneously delivered into the container, substantially all of the debris can be loosened from the inside surface of, and exhausted from, the container. A manual or electronic control can be employed to actuate both a high and a low pressure source of air simultaneously for the above cleaning operation.

More particularly the present invention relates to an apparatus for cleaning a substantially air-tight reusable container having an open side with edges that can sit flush on a flat surface containing a plurality of openings positioned to fit inside the open side of the container when the container is placed with the open side flush on the flat surface. The openings include a central port or opening connected to a vacuum or low pressure source and a plurality of other ports or openings positioned evenly in a circular pattern outside the central port and connected to an air compressor or high pressure source. A manual or electronic switch is employed to simultaneously activate the high and low pressure sources and thereby create movement of air inside the container to loosen the debris in the container and exhaust it through the central port. The capability of simultaneous activation of high and low pressure and the use of a flat surface are essential features of the present invention to make the cleaning operation more efficient and effective. Such activation is preferably accomplished by use of a sensor that responds to the presence and/or movement of the container on the flat surface.

The present invention preferably employs a flat surface, such as a table top, with sufficient durability to withstand repeated use, with several openings centered on the surface resembling a sun with planets circling the sun, albeit the planets are stationary and lie in the same orbit. The surface must also be accessible either manually or mechanically by conveyer to allow the open top of a container to cover the openings temporarily to remove debris from inside the container and then be removed from the surface. One opening (sun) is centered on the surface and a plurality and preferably four smaller openings (planets) are located in a circle outside the center opening. The smaller openings are preferably evenly positioned opposite each other and equidistant from the center opening. A vacuum machine (low pressure source) is attached to the center opening and an air compressor (high pressure source) is attached to the smaller openings. A manual or electronic switch is wired to activate the vacuum machine (electric switch) and the air compressor (pneumatic valve) for a preset period at substantially the same time. The apparatus replaced by the present invention employed a rectangular opening over which the open top of a container was placed with an air delivery system that delivered high and low pressure air at different intervals from below the plane of the rectangular opening. That arrangement proved less efficient and effective in cleaning containers as will be shown hereinafter.

The most preferred features of the present invention are a solid flat surface, openings in the surface comprising a centrally located hole or opening connected to a low pressure source and a plurality of smaller holes or openings equally distributed in a circle outside the center opening and connected to a high pressure source, and a switch wired to activate the high and low pressure air substantially simultaneously into the open top of inverted open topped containers placed on the surface over the holes. The flat surface facilitates placement and movement of the open top of a container over the holes to remove debris from inside the container by simultaneous delivery of high and low pressure into the container and subsequent removal of the container from the flat surface. A motion sensor located in close proximity to the air holes but no further from the center hole that reacts to the presence of a container over the holes is preferred over a manual switch. This frees the operator to move the container over the holes to achieve maximum cleaning efficiency, especially for large containers having a correspondingly larger open top.

LIST OF REFERENCE NUMERALS

Figure 1:
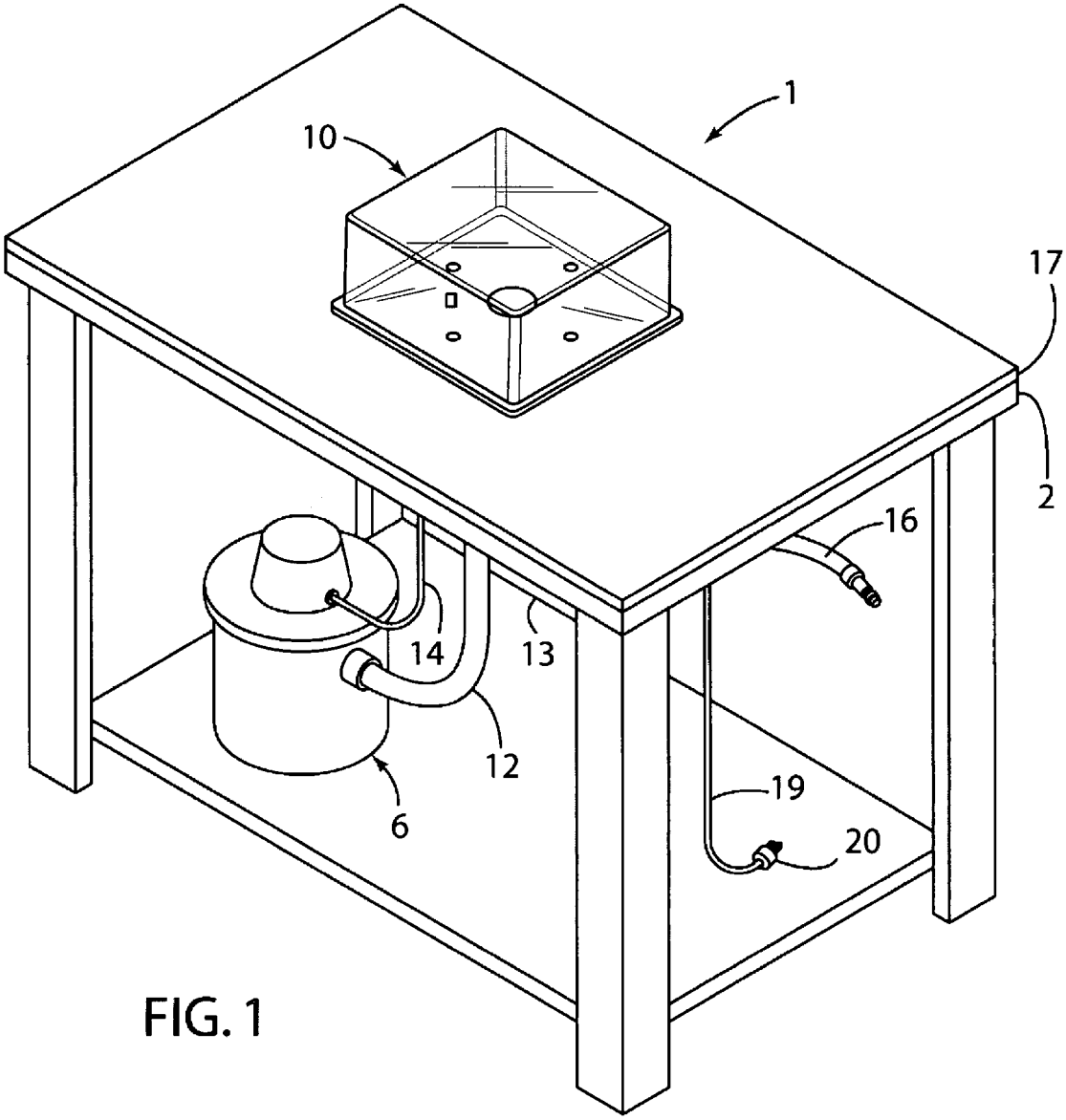
FIG. 1 is a perspective view of the invention.

1 Table
2 Table top
3 Center or vacuum hole
4*a*, 4*b*, 4*c*, 4*d* Compressed air holes
5 Air Compressor
6 Vacuum machine
9 Switch
10 Container
11 Sensor opening
12 Vacuum hose
13 Electrical control box
14 Electrical cord connecting the vacuum machine to the control box
15*a*, 15*b*, 15*c*, 15*d* Compressed air hoses connecting the compressed air source to the compressed air holes in the table top
16 Hose connection to outside source of compressed air
17 Plastic cover for table top
18 Sensor
19 Electrical cord to connect machine to outside source of electricity
20 Male plug to plug machine into an electrical outlet

DETAILED DESCRIPTION OF THE INVENTION

Figure 3:
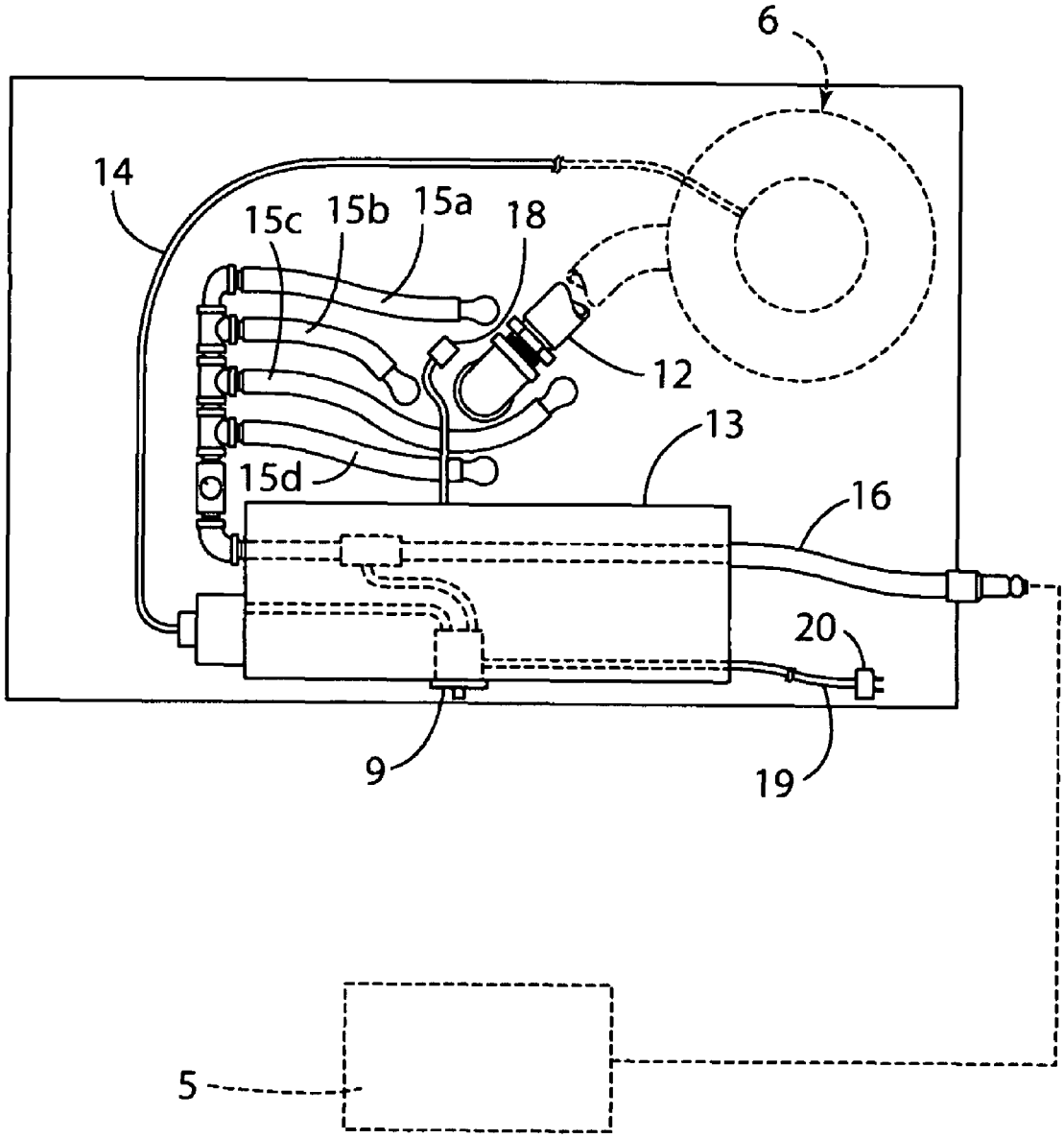
FIG. 3 is a bottom view of the invention.

FIG. 1 shows the preferred embodiment of the invention that includes a table 1 with a top 2, a large centrally located hole 3 and four smaller holes 4*a-d* distributed evenly in a 2¾ inch radius circle around the center hole 3, all five holes being centered on the table top 2. The table top 2 is 48 inches long and 34 inches wide. The center hole 3 is 1¼ inches in diameter and the smaller holes 4*a-d* are ¼ inches in diameter. These dimensions are not critical to the invention. The pattern of a central hole 3 to accommodate a source for low pressure air and outer holes 4*a-d* circling the center hole 3 is a preferred but not an essential part of the invention. The top 2 is covered by ¼ inch thick plastic cover 17 (sold under the trademark Lexan) with the same holes and dimensions as the table top 2. The plastic cover 17 is added to provide a smoother surface on the table 1 but is not essential to the invention. A 1×¼ inch rectangular hole 11 between two of the smaller holes 4*a* and 4*b* at the same distance from the center hole 3 is also cut into both parts of the table top 2, 17 to provide an opening for an electrically controlled motion sensor 18 (shown in FIG. 3) is installed under the table facing hole 11. A sensor is a preferred but not a critical feature of the invention since the high and low pressure air can be activated manually instead. An electrically controlled adjustable timer, not shown (preferably capable of being set manually from 1 to 10 seconds) is located in the control box 13 in the circuit between the sensor 18 and the switches that turn on the low and high pressure sources simultaneously and control the length of time they stay on. The machine derives its power by inserting male plug 20 at the end of electric cord 19 into an ordinary electric outlet. The time interval is determined empirically depending on the size of the containers to be cleaned and the amount and type of debris involved. The configuration of table 1 is not an essential part of the invention but a flat surface like a table top is. The flat surface could instead be part of an automatic conveyer system that feeds containers to the flat surface for cleaning and then removes the container, all mechanically by means that are all within the ordinary skill of those familiar with the automation and conveyer art.

FIG. 1 also displays a vacuum machine 6, most commonly sold under the trademark Shop Vac, that is an example of a low pressure source most suitable for use in situations where relatively small containers 10 are to be cleaned. Commonly used totes with inside dimensions measuring 18×10×4 inches are examples of such containers 10. A vacuum source with a larger capacity for larger volumes or larger sizes of containers is also within the contemplation of the present invention. FIG. 1 also shows the electrical cord that connects the vacuum machine 6 to the control box 13, the electrical cord 19 and the male plug 20 that connects the machine to an electrical outlet and the compressed air hose 16 that connects the machine to an outside source of compressed air, all better seen in FIG. 4.

While an air compressor 5 connected to the smaller holes 4*a-d* and a vacuum machine 6 connected to the center hole 3 can be used in a more portable machine, the machine shown in FIGS. 1-4 is designed for use in a factory where compressed air is already available for other uses. A dedicated air compressor with the capability of producing up to about 80 psi has proven appropriate for relatively small volumes or sizes of containers.

Figure 2:
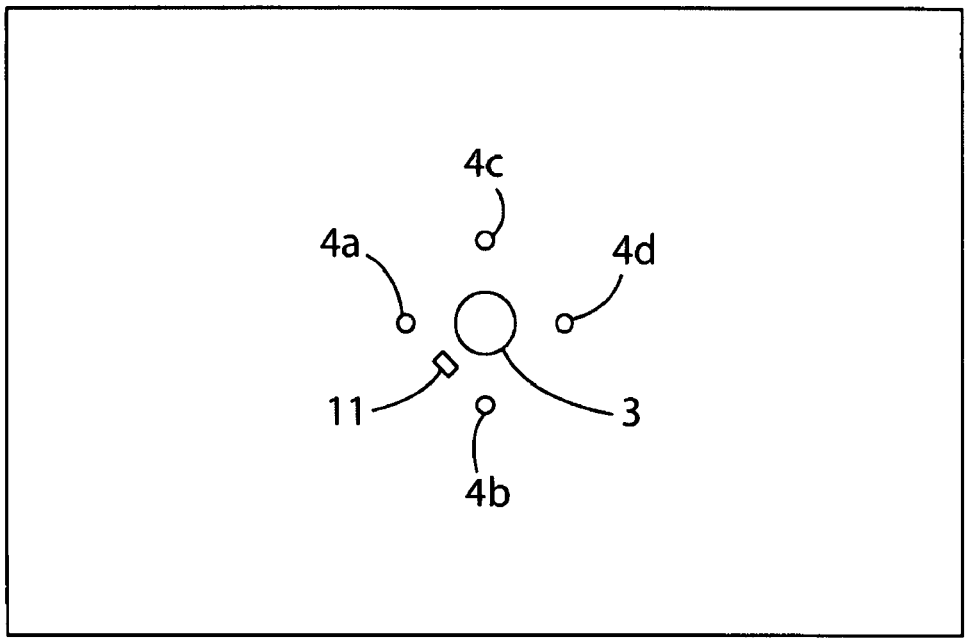
FIG. 2 is a top view of the invention.
Figure 4:
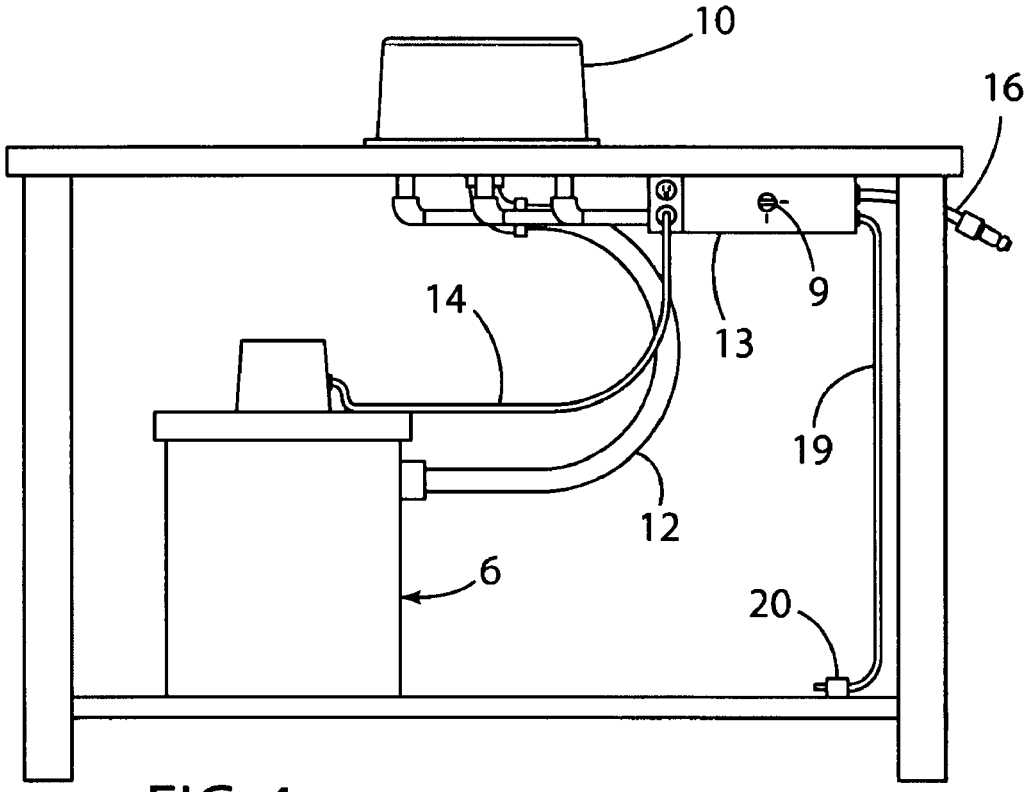
FIG. 4 a front view of the invention.

FIG. 2 gives a better view of the holes 3, 4*a-d*, 11 cut into the table top 2. FIG. 4 shows how the switch 9, vacuum 6, and electrical control box 13 are connected to the table 1. For example, the vacuum 6 is connected to the switch 9 by electric cord 14, the switch 9 is connected to the electrical control box 13 by electric cord 14, the vacuum 6 is connected to the center hole 3 by vacuum hose 12, the compressed air holes 4*a-d* are connected to the control box 13 by compressed air hoses 15*a-d* and the electrical control box 13 is attached to the bottom of table 1. The locations and specific configuration of the vacuum machine, compressed air source, the control box; the switch and the connections identified by the reference numerals 6; 9, 19, 13, 12, 15*a-d*, 14 are not critical to the invention but the fact that they combine to deliver high and low pressure air to the holes 3, 4*a-d* in the flat surface of the table 1 substantially simultaneously is. The specific manner in which the components are assembled and the selection and types of the materials used are well within the skill of those with ordinary skill in the art of manufacturing such machines. It is essential that the controls and connections facilitate the simultaneous delivery of compressed air pressure and vacuum pressure into the container 10 at the same time to achieve maximum cleaning efficiency. The amount of air and vacuum pressure delivered depends on the size and nature of the containers to be cleaned and the type and volume of debris to be removed from the containers. The debris commonly includes small pieces and shavings of metal, plastic, paper and foam. Selection of the amount of air and vacuum pressure is an empirical process. For the particular size and type of container illustrated and the type of debris encountered in an automobile manufacturing facility a 6 gallon, 2.5 horse power vacuum and a compressed air pressure of 60 pounds per square inch proved adequate to clean the totes most commonly used.

To summarize, the manner in which the table 1 is constructed, the holes 3, 4*a-d* are cut or drilled into the table top, the manner in which the vacuum machine 6 and the air compressor 5 are connected to the holes 3, 4*a-d* and even the type of vacuum machine 6 and air compressor 5 employed are not critical and well within the skill of those ordinarily employed to build such machines. It is only important that those features be durable and capable of delivering air in sufficient quantities to loosen and exhaust debris from the containers 10 that a person wishes to clean, essentially an empirical process of selection.

Typically the preferred embodiment of the present invention is placed next to conveyer that delivers the containers to an operator sitting in front of the machine located in a perpendicular orientation to the conveyor. When a container reaches the operator he picks up the container and places the open top over the holes in the top of the table 1. The sensor 18 senses the presence of the container and sends an electric current to the timer inside the control box 13. The timer, which has previously been set to run anywhere from 1-10 seconds, sends a current to simultaneously activate the electronic switch 9 that turns on the vacuum machine 6 and the pneumatic switch that turns on the compressed air. The operator then picks up the container 10, checks to see if the debris inside the container has been removed, and places it on a skid sitting next to the table for removal by a fork truck when the skid if filled up. One advantage of the present invention is that the operator can easily replace the container 10 the machine over the holes 3, 4*a-d* if he finds that it has not been adequately cleaned by one pass; or, especially if the open top of the container 10 is substantially larger than the space occupied by the holes in the table top 2, he can slide the container back and forth over the holes to direct the air more completely over the inside surface of the container 10. The machine that was replaced by the present machine would not permit movement of various sized containers because the open top of a container had to fit into or over the fixed opening from below which the air was delivered into the container.

A separate embodiment of the invention that is not shown in the drawings was assembled by the inventor and subsequently tested and actually employed commercially in the following manner from materials that happened to be available where the inventor happened to be employed. Thus the following embodiment was not a preferred embodiment but it contains the same basic components and works in essentially the same manner as the preferred embodiment shown in the drawings. This original embodiment has the advantage of being a proven example of the present invention and is therefore described in detail below.

A rectangular frame measuring 66 inches long, 33 inches wide and 31 inches high was constructed using two inch square steel tubing. A steel mesh screen made out of ⅛ inch diameter wire was welded to the top and bottom of the frame. The openings in the screen were diamond shaped with dimensions of ½ inch long by ¼ inch wide. A flexible plastic mesh screen was attached to the back of the frame using Velcro™ strips. A 30 inch square opening was cut in the center of the mesh screen on the top of the frame. A 10 inch square hole was cut along the back center of the mesh screen on the bottom of the frame. Five inch tall rollers were added to the four lower corners of the frame. A 33×31 inch thick steel plate was cut. A two inch diameter hole was cut in the center of the steel plate. Four ½ inch diameter holes were cut around the center hole equidistant from the center hole in a 6 inch square pattern.

The open end of the three foot long, two inch diameter vacuum hose attached to a 5.0 HP×12 gal capacity vacuum machine was first fastened to a 2 inch barb which was then press fitted into the center hole in the steel plate leaving a flush surface on the steel plate. Two pairs of 2 inch by 28 inch rectangular steel rods were welded under the 33 inch edge of the steel plate. Two pairs of round ¼ inch by 14¾ inch steel rods were welded 1½ inches apart to the rectangular rods, each pair being centered under each pair of ½ inch openings for the compressed air hoses. One 15 inch long two inch wide rectangular bracket fashioned out of ⅛ inch diameter wire with 1½ inch by ½ inch diamond shaped openings having a hinge at one end and a clasp on the other end was first attached by its hinged end to the rectangular rod at one end of one pair of the round rods. A second such rectangular bracket was likewise attached to the other pair of round rods. Using each hole in ⅜ inch inside diameter, one inch outside diameter steel washers on each side of the openings in the brackets that align with the four ½ inch openings in the steel plate, a fitting with a ⅜ inch female pipe thread on one end and a ⅜ inch nipple on the other end was connected to a fitting with ⅜ inch male thread on one end and a ⅜ inch nipple on the other end, leaving both nipples exposed on each side of the bracket. The ends of two 6 inch long ⅜ inch inside diameter compressed air hoses were attached to the exposed nipples of the fittings on the underside of the brackets. A one inch long equally sized piece of the compressed air hose was attached to the nipples on the top side of the brackets. A ¼ inch long, 1 inch wide plastic rivet was snapped together over the ½ inch holes in the steel plate. The latch at the other end of the brackets was designed to close on the rectangular steel rods under the steel plate and thereby enable the compressed air hoses on the top of the brackets to close tightly against the rivets on the bottom side of the steel plate leading to an air tight fit. One 6 inch long piece of ⅜ inside diameter compressed air hose was attached to the exposed nipples under one bracket and another equally sized piece of compressed air hose was attached to the corresponding pair of exposed nipples on the other bracket.

These 6 inch hoses were in turn connected to each other at their midpoints using another 6 inch long piece of equally sized compressed air hose using ⅜ inch tees. Finally the connecting hose was connected at its midpoint using a third ⅜ inch tee to an equally sized, 10 foot long hose attached to the foot pedal and thence to an air compressor capable of delivering up to 80 psi air pressure. The electric cord from the vacuum was plugged into an outlet mounted inside the frame and was turned on when the electric switch on the foot pedal was pressed. The outlet in the frame was equipped with a 20 foot extension cord which was plugged into a wall outlet and a separate cord that was connected to a foot operated switch for the vacuum, to be turned on when the foot pedal is depressed. The steel plate was placed over the hole in the mesh screen in the top of the frame. The vacuum and air compressor were placed inside the frame through the back of the frame by lifting the flexible plastic screen on the back of the frame. The connections leading to the foot switch were passed through the opening in the mesh screen covering the bottom of the frame. Thus in operation the foot pedal was located outside and in back of the machine so the operator could access it to operate the machine. The top of the fully assembled machine was covered by a 66 inch long, 33 inch wide, ¼ inch thick transparent plastic sheet (Plexiglass). Four 2 inch long, ⅜ inch wide bolts and matching nuts drilled into the corners of the plastic sheet were used to fasten the plastic sheet to the steel mesh top.

The vacuum and compressed air machines were controlled by a foot switch that was equipped to turn the vacuum and the compressed air on and off simultaneously using an electric push bottom switch for the vacuum and a pneumatic push button valve for the compressed air. The frame for the foot switch was built using a ¼ inch thick 10×6 inch steel plate. A 9×2¾ inch foot pedal hinged on 4×5 inch plate was fastened in a raised position to one end of the frame using two ¼×2½ inch nuts and bolts and two upright 1½ inch square, ¼ inch thick steel plates. A second ½×4 inch foot pedal hinged on ¼ by 4 inch bolt was welded to the frame underneath the first pedal in close enough proximity so that the two pedals could be moved simultaneously to engage both a push button electrical switch for the vacuum and a pneumatic valve for the air compressor underneath the pedal. An electrical box fastened to the other end of the foot pedal frame was used to house the electrical junction for the foot switch to the electrical outlet in the frame into which the vacuum and the air compressor were plugged. The box was 4 inches long, 1¾ inches wide, and 1¾ inches high. Two compressed air hoses were used to connect the foot switch to the air compressor.

To operate the completed machine, the operator sat on a chair or a rotating stool facing the machine. In actual operation a roller table was placed on the right side of the machine. A skid was placed on the left side of the machine. The containers were fed to the operator on the roller table within his reach. He placed the open top of each container on the table over the openings and pressed and quickly released the foot switch. He then picked up, turned over and stacked the cleaned containers on the skid until the skid was full. A forklift driver then took the loaded skid away.

The last embodiment of the cleaning machine of the present invention was used in production to replace another machine previously used to clean totes measuring 18×10×4 inches of inside dimensions and produced the best results operating at 5.0 HP vacuum and 60 psi air pressure. The replaced machine also employed compressed air blown directly into and vacuumed out of the open top of the same totes but high and low pressure were not activated simultaneously and a rectangular open topped enclosure with sides that tapered down several inches to a smaller bottom surface from which the vacuum and compressed air was delivered, not from a flat surface like the present machine. The open top of the totes had to be fitted by hand directly over the similarly sized opening in the replaced machine carefully to trap the vacuum and compressed air which originated from ports several inches below the open top of the totes. The present machine outperformed the previous equipment both in number of totes cleaned per day and also in the effectiveness of the cleaning process. Thus more and cleaner totes were produced faster even after cutting the work force and the number of shifts employed.

The foregoing provides both a general and specific description of a preferred embodiment of the invention. It should be understood that various substitutions, variations, and modifications can be made by those skilled in the art without departing from the spirit or scope of the invention as further delineated in the following claims.

The invention claimed is:

1. An apparatus for cleaning a substantially air-tight reusable container, said container having an open side whose edges are shaped to sit flush on a flat surface and thereby trap air inside said container, said apparatus comprising a flat surface having a plurality of openings positioned to fit inside said open side of said container when said open side is placed on said surface over said openings, said openings comprising a first opening centrally located on said flat surface and a plurality of other smaller openings spread evenly in a circular and opposing relationship around and equidistant from said first opening, said first opening being connected to a low pressure source and said smaller openings being connected to a high pressure source, said smaller openings thereby being capable of creating a curtain of high pressure around said first opening, and means for substantially simultaneously activating said high and low pressure sources inside said container through said open side when said open side of said container is placed on said flat surface over said openings.

2. The apparatus of claim 1 wherein said flat surface is a table top.

3. The apparatus of claim 2 wherein said smaller openings are four in number.

4. The apparatus of claim 1 wherein an electronic sensor is placed under an additional opening in said flat surface, said additional opening being located no further from said first opening than said smaller openings, said sensor being capable of i. sensing the presence of said container when said container is placed over said openings and ii. sending an electric current to turn said low pressure source and said high pressure source on.

5. An apparatus for cleaning substantially air-tight containers having an open top, said apparatus comprising a) A flat surface, b) A low pressure source capable of exhausting air and debris through a first opening centrally located on said flat surface, c) A high pressure source capable of delivering air under pressure through a plurality of small openings spread evenly around and equidistant from said first opening and d) A switch capable of activating both said high and low pressure sources substantially simultaneously to remove debris from said containers when said open top is placed flush on said flat surface over said openings.

6. The apparatus of claim 5 wherein a) said flat surface is a table top, b) said low pressure source is a vacuum machine, c) said high pressure source is an air compressor, d) said smaller openings are four in number, e) said switch for activating said vacuum machine and air compressor is wired to be turned on by a sensor capable of sensing the presence of a container placed over said openings through another opening in said table top located no further from said first opening than said smaller openings.

* * * * *